US009492997B2

(12) United States Patent
Zhang et al.

(10) Patent No.: US 9,492,997 B2
(45) Date of Patent: Nov. 15, 2016

(54) LIQUID EJECTING APPARATUS

(71) Applicant: Seiko Epson Corporation, Tokyo (JP)

(72) Inventors: Junhua Zhang, Shiojiri (JP); Satoru Hosono, Azumino (JP)

(73) Assignee: Seiko Epson Corporation (JP)

( * ) Notice: Subject to any disclaimer, the term of this patent is extended or adjusted under 35 U.S.C. 154(b) by 242 days.

(21) Appl. No.: 13/783,677

(22) Filed: Mar. 4, 2013

(65) Prior Publication Data

US 2013/0235105 A1 Sep. 12, 2013

(30) Foreign Application Priority Data

Mar. 12, 2012 (JP) ..... 2012-055136

(51) Int. Cl.
*B41J 2/045* (2006.01)

(52) U.S. Cl.
CPC ..... *B41J 2/0454* (2013.01); *B41J 2/04516* (2013.01); *B41J 2/04553* (2013.01); *B41J 2/04581* (2013.01); *B41J 2/04588* (2013.01)

(58) Field of Classification Search
USPC ..... 347/9, 11, 15
See application file for complete search history.

(56) References Cited

U.S. PATENT DOCUMENTS

| | | | | |
|---|---|---|---|---|
| 6,598,950 | B1 * | 7/2003 | Hosono | B41J 2/04581 347/10 |
| 6,840,595 | B2 * | 1/2005 | Kusunoki | B41J 2/04581 347/10 |
| 2002/0167559 | A1 * | 11/2002 | Hosono | B41J 2/04588 347/11 |
| 2003/0001912 | A1 * | 1/2003 | Kusunoki | B41J 2/04581 347/11 |
| 2003/0107617 | A1 | 6/2003 | Okuda et al. | |
| 2011/0080444 | A1 * | 4/2011 | Kaieda et al. | 347/11 |
| 2011/0090272 | A1 * | 4/2011 | Matsuo | 347/10 |
| 2011/0096111 | A1 * | 4/2011 | Matsuo | 347/10 |
| 2011/0109676 | A1 * | 5/2011 | Tsubota et al. | 347/11 |
| 2011/0316915 | A1 * | 12/2011 | Matsushita | 347/10 |
| 2012/0306954 | A1 * | 12/2012 | Nishikawa | 347/11 |
| 2013/0083107 | A1 * | 4/2013 | Nishikawa et al. | 347/10 |
| 2013/0215172 | A1 * | 8/2013 | Kaneko | B41J 2/04581 347/10 |

FOREIGN PATENT DOCUMENTS

| | | |
|---|---|---|
| JP | 11-170518 | 6/1999 |
| JP | 2000-153608 | 6/2000 |
| JP | 2000-280458 A | 10/2000 |
| JP | 2001-334659 A | 12/2001 |
| JP | 2009-286108 A | 12/2009 |

* cited by examiner

*Primary Examiner* — Matthew Luu
*Assistant Examiner* — Lily Kemathe
(74) *Attorney, Agent, or Firm* — Harness, Dickey & Pierce, P.L.C.

(57) ABSTRACT

A liquid ejecting apparatus includes a liquid ejecting head in which liquid is ejected from a nozzle as liquid droplets using a driving signal generated by a driving signal generation unit, wherein the driving signal generation unit fits a difference between a maximum voltage and a minimum voltage, and generates a first driving signal that is transmitted when an ambient temperature is within a predetermined low temperature range, and a second driving signal that is transmitted when the temperature is within a predetermined high temperature range, further the first and second driving signals include a first element that forms a liquid column by pressurizing the pressure chamber and projecting the liquid in the nozzle, and a second element that projects the pressure chamber in a projecting direction of the liquid column from a position where a liquid surface inside the nozzle is connected to an internal surface of the nozzle.

8 Claims, 8 Drawing Sheets

LIQUID EJECTING APPARATUS

BACKGROUND

1. Technical Field

The present invention relates to a liquid ejecting apparatus, and particularly to a liquid ejecting apparatus which is useful to be applied to prevent satellite of liquid droplets ejected from a nozzle from generating.

2. Related Art

An ink jet type recording apparatus is proposed which ejects ink in a pressure chamber from a nozzle as droplets by changing a pressure of the pressure chamber using a pressure generation element of a piezoelectric vibrator, a heating element or the like. In this type of recording apparatus, when the ink in the pressure chamber of an ink jet type recording head is pressurized, a liquid column is projected from a base surface of the liquid in the nozzle. A front end portion of the liquid column is ejected as main droplets, a tail portion of the liquid column (a rear end portion of the liquid column) is ejected as satellite droplets smaller than the main droplets. The satellite droplets are deposited in an unintended position on a deposition object (for example, a recording sheet), whereby decreasing an accuracy (for example, a printing accuracy) of a deposition position, or the satellite droplets becomes drifting mists, whereby contaminating a liquid ejecting apparatus. Thus, it is necessary to suppress the generation of the satellite droplets.

JP-A-11-170518 discloses a technology that a piezoelectric element for ejecting ink droplets, and a piezoelectric element for preventing satellite droplets are provided in a single pressure chamber. When ejected, after the ink column is formed by projecting the ink from a nozzle by driving the piezoelectric element for ejecting ink droplets, and the ink column is cut off by projecting a rear end portion of the ink column by driving the piezoelectric element for preventing satellite droplets, thereby suppressing the generation of the satellite droplets.

In the technology of JP-A-11-170518, the piezoelectric element for preventing the satellite droplets is provided in addition to the piezoelectric element for ejecting the ink droplets. Thus, the structure is complicated and it is necessary to individually drive multiple piezoelectric elements, respectively.

In addition, such a problem exists not only in an ink jet type recording apparatus, but also in a liquid ejecting apparatus which ejects liquid except for the ink.

SUMMARY

An advantage of some aspects of the invention is to provide a liquid ejecting apparatus which can suppress from generating satellite droplets accompanied by liquid ejection as much as possible while a voltage difference between a maximum voltage and a minimum voltage of a driving signal is restricted within a predetermined range.

According to an aspect of the invention, there is provided a liquid ejecting apparatus that includes a liquid ejecting head in which a pressure inside a pressure chamber is varied by a pressure generation unit and liquid in the liquid ejecting is ejected from a nozzle as liquid droplets, and a control unit which includes a driving signal generation unit generating a driving signal which operates the pressure generation unit. The driving signal generation unit fits a difference between a maximum voltage and a minimum voltage onto a predetermined range, and generates a first driving signal that is transmitted to drive the liquid ejecting head when an ambient temperature detected by a temperature sensor is within a predetermined low temperature range, and a second driving signal that is transmitted to drive the liquid ejecting head when the temperature detected by the temperature sensor is within a predetermined high temperature range, wherein the first and second driving signals include a first elements that form liquid columns by pressurizing the pressure chamber and projecting the liquid in the nozzle. A second element projects in a projecting direction of the liquid column at a position where a liquid surface inside the nozzle is connected to an internal surface of the nozzle, in a state where at least the second driving signal pressurizes the pressure chamber via the first element after the first element, the liquid column is connected to the liquid in the nozzle.

According to the aspect of the invention, when the ambient temperature is within the predetermined low temperature range, the liquid ejecting head is driven by the first driving signal, and when the ambient temperature is within the predetermined high temperature range, the liquid ejecting head is driven by the second driving signal. When the liquid ejecting head is driven by the second driving signal, generation of the satellite droplets is suppressed. In other words, in driving performed by the second driving signal, since the liquid column is formed from a base surface by the supply of the first element, the second element is supplied in a state where the liquid column is connected to the liquid in the nozzle, and the portion (that is, the base surface of the liquid) except for the liquid column surface in the liquid surface is extruded, the tail portion of the liquid column becomes thin, and a surface tension trying to return to the ejection surface is operated, thereby the liquid column is divided easily. Accordingly, when the liquid droplets are formed, it is possible to suppress generation of the satellite droplets.

On the other hand, viscosity of the liquid is small within the high temperature range, and thus ejection energy may be small when the desired liquid droplets are ejected. For this reason, the voltage difference of the first element which is a pressuring element of a driving signal necessary to eject the liquid in the nozzle by pressurizing the pressure chamber may be small. As a result, when a high temperature range voltage difference which is a difference between a maximum voltage difference and a minimum voltage difference within the high temperature range is applied to a range of a regulation voltage difference which is a difference between the maximum voltage and the minimum voltage regulated based on the driving signal within the low temperature range, the regulation voltage difference becomes larger than the high temperature range voltage difference, and a margin voltage difference is generated which is a difference between the regulation voltage difference and the high temperature range voltage difference. It is possible to easily form the second element following the mist suppression element using the margin voltage difference range.

Here, it is preferable that the first driving signal also include a second element as the same as the second driving signal which pressurizes the pressure chamber via a mist suppression element after the first element. Moreover it is preferable that a voltage change amount of the second element of the first driving signal become less than the voltage change amount of the second element of the second driving signal. In this case, it is possible to suppress the generation of the satellite droplets even by the first driving signal.

In addition, it is preferable that a voltage change width of the second element of the second driving signal be within two fifths of the voltage change width of the first element. In this case, the degree of a second pressurization for extruding the liquid surface can be suppressed smaller than the degree of a first pressurization for projecting the liquid column.

Furthermore, it is preferable that when a height with respect to an ejection surface of the liquid column formed by the first element of the second driving signal be two times a diameter of the nozzle or more and five times the diameter of the nozzle or less, the second element be started. In this case, that is because it is possible to avoid situations where it is difficult to form the liquid droplets due to a short liquid column, or to form an adequately size of liquid droplets due to an extremely long liquid column.

It is preferable that a height with respect to an ejection surface of the liquid surface projected by the second element of the second driving signal be a half of a diameter of the nozzle or more and three seconds of the diameter of the nozzle or less. In this case, that is because it is possible to more effectively suppress formation of the satellite droplets. Furthermore, it is preferable that time t between an application start of the second element of the second driving signal and an application start of the first element be $Tc/2<t<Tc$ (note that Tc is a period of natural vibration of the pressure chamber).

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described in detail with reference to the drawings.

First Embodiment

Figure 1:
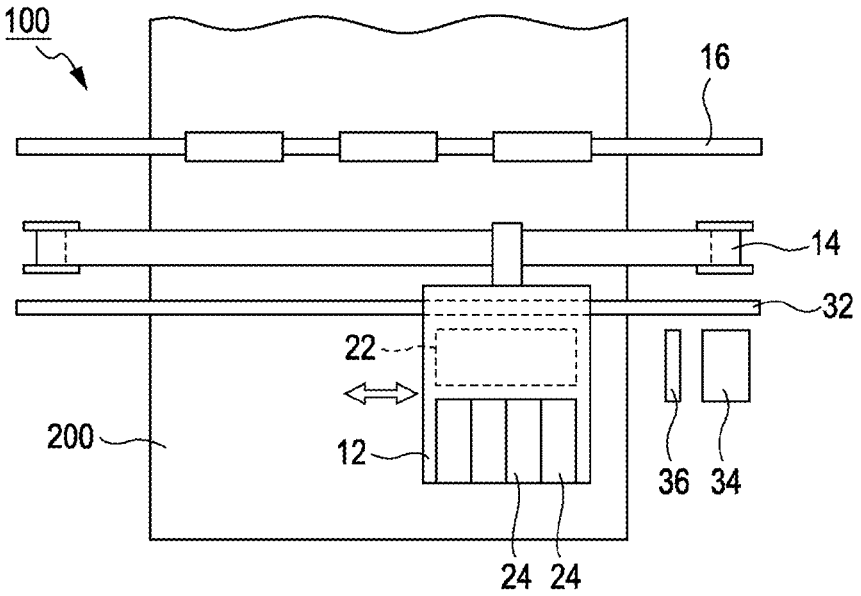
FIG. 1 is a partial schematic diagram of a printing apparatus according to a first embodiment of the invention.

FIG. 1 is a partial schematic diagram illustrating an ink jet type printing apparatus which is a liquid ejecting apparatus according to a first embodiment of the invention. As illustrated in FIG. 1, the printing apparatus 100 is the liquid ejecting apparatus which ejects fine ink droplets onto a recording sheet 200, and includes a carriage 12, a moving device 14 and a paper transporting device 16. In the carriage 12, a recording head 22 functioning as a liquid ejecting unit is installed, and an ink cartridge 24 for storing ink supplied to the recording head 22 is detachably mounted. In addition, a configuration which supplies the ink to the recording head 22 can be adopted by fixing the ink cartridge 24 to a housing (not shown) of the printing apparatus 100.

The moving device 14 reciprocates the carriage 12 along a guide shaft 32 in a main scanning direction (a width direction of the recording sheet 200 indicated by an arrow in FIG. 1). A position of the carriage 12 is used to control the moving device 14 by being detected by a detector (not shown) such as a linear encoder. The paper transporting device 16 transports the recording sheet 200 in a sub-scanning direction in parallel with the reciprocation of the carriage 12. A desired image is recorded (printed) on the recording sheet 200 by ejecting the ink droplets onto the recording sheet 200 using the recording head 22 at the time of the reciprocation of the carriage 12. In addition, in the vicinity of end points of the reciprocation of the carriage 12, a cap 34 for sealing an ejection surface of the recording head 22 or a wiper 36 wiping the ejection surface is installed.

Figure 2:
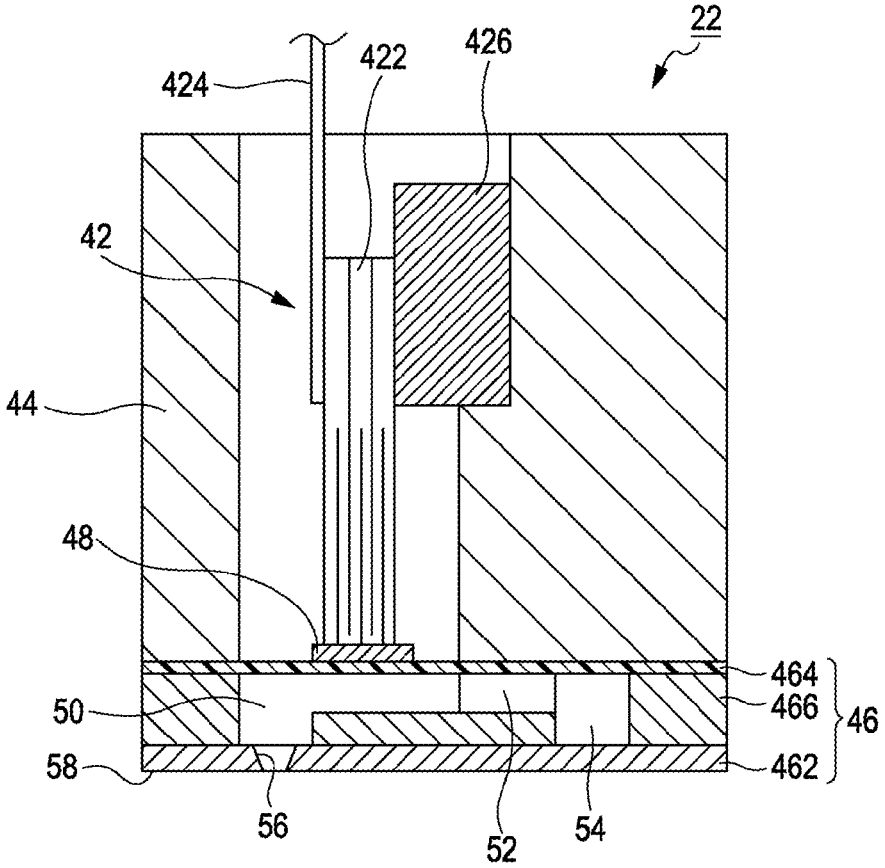
FIG. 2 is a cross-sectional view of a recording head.

FIG. 2 is a cross-sectional view (a cross-section perpendicular to the main scanning direction) of the recording head 22. As illustrated in FIG. 2, the recording head 22 includes a vibration unit 42, an accommodation body 44 and a flowing path unit 46. The vibration unit 42 includes a piezoelectric vibrator 422, a cable 424 and a fixing plate 426. The piezoelectric vibrator 422 is a longitudinal vibration type piezoelectric element in which piezoelectric material and an electrode are alternately laminated, and vibrates according to a driving signal supplied via the cable 424. The vibration unit 42 is accommodated in the accommodation body 44 in a state where the fixing plate 426 for fixing the piezoelectric vibrator 422 is bonded to the inner wall surface of the accommodation body 44.

The flowing path unit 46 is a structure in which a flowing path forming plate 466 is interposed in a gap between a substrate 462 and a substrate 464 opposing to each other. The flowing path forming plate 466 forms a space which includes a pressure chamber 50, a supplying path 52, and a storage chamber 54 in the gap between the substrate 462 and the substrate 464. The pressure chamber 50 is separately divided by partition walls for each vibration unit 42, and communicates with the storage chamber 54 via the supplying path 52. Multiple nozzles (ejecting holes) 56 corresponding to each pressure chamber 50 are formed in the substrate 462 in a row. An ejecting surface 58 is a surface of a side opposing to the pressure chamber 50 of the substrate 462. Each nozzle 56 is a via hole through which the pressure chamber 50 communicates with the outside. Ink supplied from the ink cartridge 24 is stored in the storage chamber 54. As is understood from the above description, an ink flowing path is formed between the storage chamber 54 and the outside via a supplying path 52, the pressure chamber 50 and the nozzle 56.

The substrate 464 is a flat material formed by an elastic material. An island type island section 48 is formed in an area opposing to the pressure chamber 50 in the substrate 464. The substrate 464 configuring a portion of the pressure chamber and the island section 48 becomes a vibration plate formed to vibrate by driving the piezoelectric vibrator 422. A front end surface (free end) of the piezoelectric vibrator 422 is bonded to the island section 48. However, when the piezoelectric vibrator 422 is vibrated by a driving signal supply, the substrate 464 is displaced via the island section 48, thereby bulk of the pressure chamber 50 is changed, and thus ink pressure inside the pressure chamber 50 is varied. In other words, the piezoelectric vibrator 422 functions as pressure generating unit which makes pressure inside the pressure chamber 50 vary. It is possible to eject the ink droplets from the nozzle 56 according to pressure variation inside the pressure chamber 50 described above.

Figure 3:
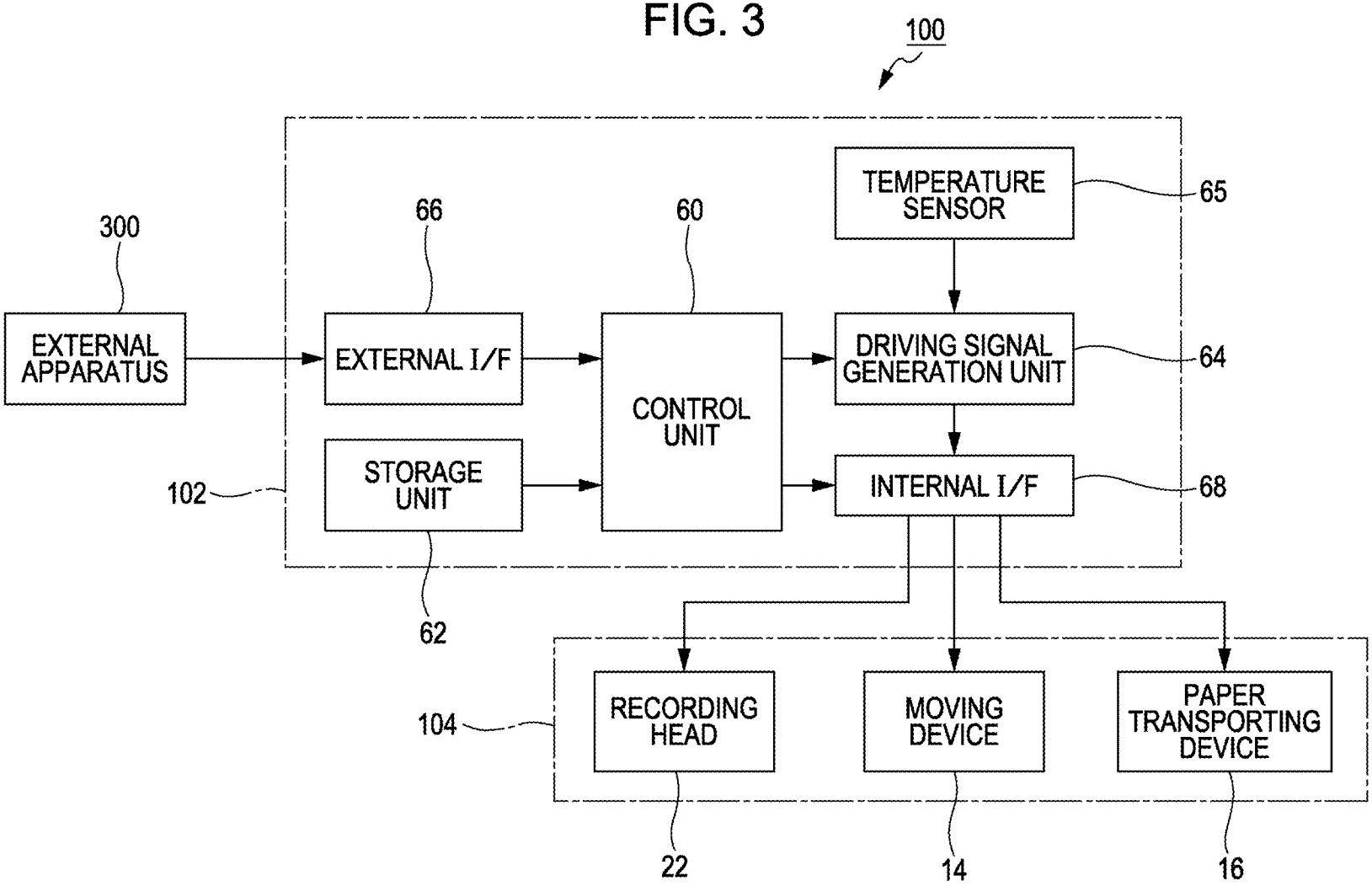
FIG. 3 is a block diagram of an electrical configuration of the printing apparatus.

FIG. 3 is a block diagram of an electrical configuration of the printing apparatus 100. As illustrated in FIG. 3, the printing apparatus 100 includes a control apparatus 102 and a print processing unit (a print engine) 104. The control apparatus 102 is an element which controls the whole of the printing apparatus 100, and includes a control unit 60, a storage unit 62, a driving signal generation unit 64, an external I/F (an interface) 66 and an internal I/F 68. Printing data displaying images printed on the recording sheet 200 is supplied to the external I/F 66 from an external apparatus (for example, a host computer) 300, and the print processing unit 104 is connected to the internal I/F 68. The print processing unit 104 is an element which records the images on the recording sheet 200 under a control of the control apparatus 102, and includes the recording head 22, the moving device 14 and paper transporting device 16 that are described above.

The storage unit 62 includes a ROM which stores a control program or the like, and a RAM which temporarily stores various data necessary for image print (ejection of the ink droplets for each nozzle 56). The control unit 60 executes the control program stored in the storage unit 62, thereby totally controlling each element of the printing apparatus 100 (such as the moving device 14 of the print processing unit 104 or the paper transporting device 16). In addition, the control unit 60 convert the print data supplied to the external I/F 66 from the external apparatus 300 into ejection data D (refer to FIG. 4) instructing the ejection/non-ejection of the ink droplets for each piezoelectric vibrator 422 from each nozzle 56 of the recording head 22. The driving signal generation unit 64 generates the driving signal and supplies the generated driving signal to the recording head 22 via the internal I/F 68. The driving signal COM is a periodic signal which ejects the ink droplets from the nozzle 56 of the pressure chamber 50 by driving each piezoelectric vibrator 422. According to the present aspect, the driving signal generation unit 64 selectively transmits any one of a first driving signal COM1 and a second driving signal COM2, based on ambient temperature detected by a temperature sensor 65 (this point will be described later).

Figure 4:
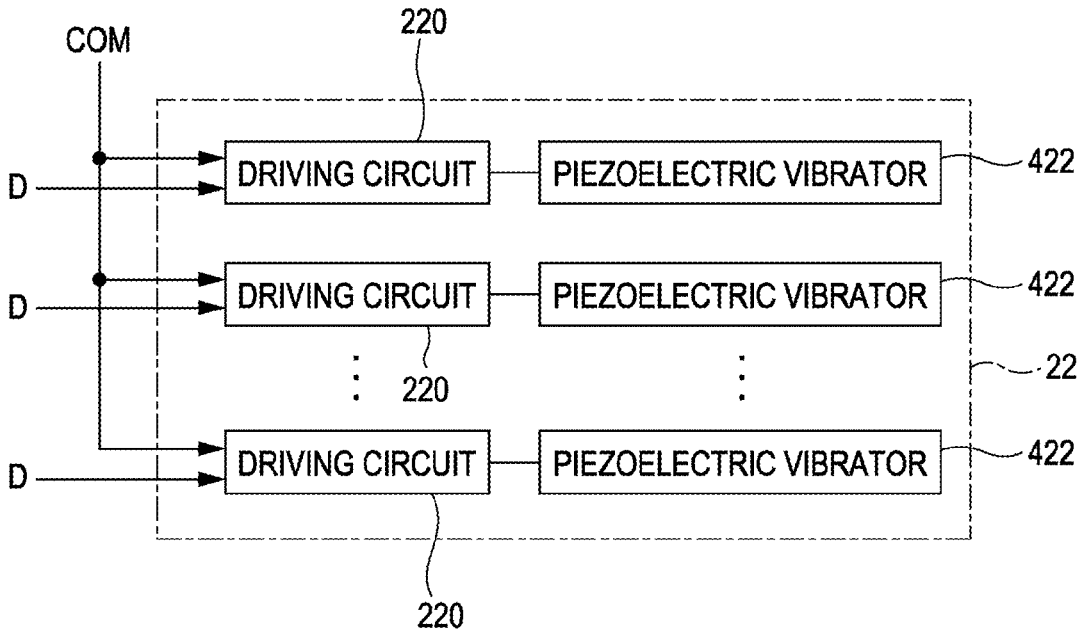
FIG. 4 is a block diagram of an electrical configuration of the recording head.

FIG. 4 is schematic diagram of an electrical configuration of the recording head 22. As illustrated in FIG. 4, the recording head 22 includes multiple driving circuits 220 corresponding to different nozzles 56 (the piezoelectric vibrator 422). The driving signal COM is supplied to multiple driving circuits 220 in common. In addition, the ejection data D generated by the control unit 60 is supplied to each driving circuit 220 via the internal I/F 68.

Each driving circuit 220 supplies the first and second driving signals COM1 and COM2 (see FIGS. 5A and 5B) to the piezoelectric vibrator 422 according to the ejection data D. Specifically, when the ejection data D instructs the ejection of the ink droplets, the driving circuits 220 supply to drive the first and second driving signals COM1 and COM2 to the piezoelectric vibrator 422, and vibrate a vibration plate (the island section 48 and the substrate 464). For this reason, inside of the pressure chamber 50 is pressurized via the substrate 464, and the ink droplets are ejected onto the recording sheet 200 from the nozzle 56. On the other hand, when the ejection data D instructs the non-ejection (stop of the ejection) of the ink, the driving circuits 220 do not supply the first and second driving signals COM1 and COM2 to the piezoelectric vibrator 422. Therefore, the ink droplets are not ejected from the nozzle 56 of the pressure chamber 50. In addition, when the ejection data D instructs the non-ejection of the ink, the driving circuit 220 drives the piezoelectric vibrator 422 by supplying the driving signal COM to the piezoelectric vibrator 422, and it is preferable that the vibration plate (the island section 48 and the substrate 464) is vibrated to the extent that the ink droplets are not ejected. For this reason, micro vibration is applied to liquid in the pressure chamber 50 and liquid in the nozzle via the substrate 464. In this case, the ink is not ejected from the inside of the pressure chamber 50 and properly agitated.

Figure 5A:
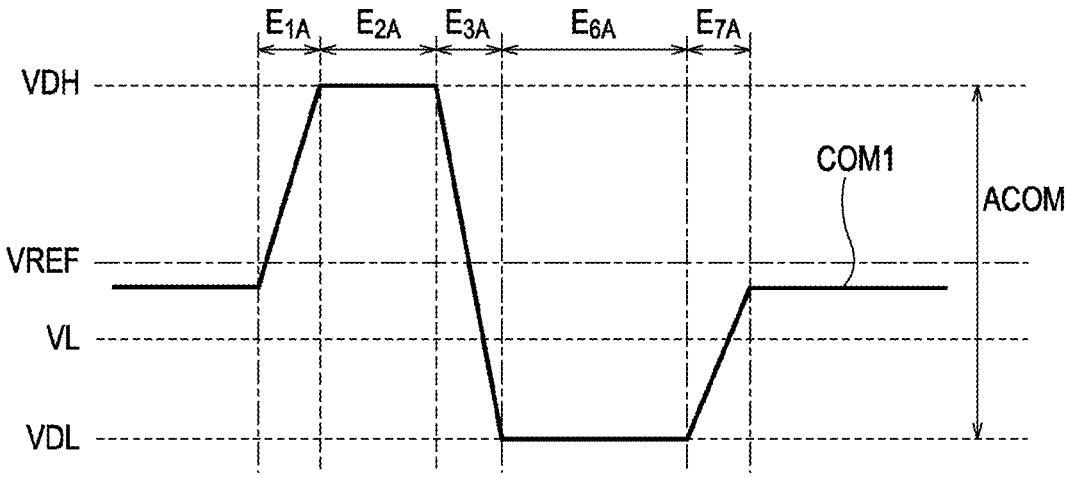
FIG. 5A is a waveform diagram illustrating an example of a first driving signal and FIG. 5B is a waveform diagram illustrating an example of a second driving signal.
Figure 5B:
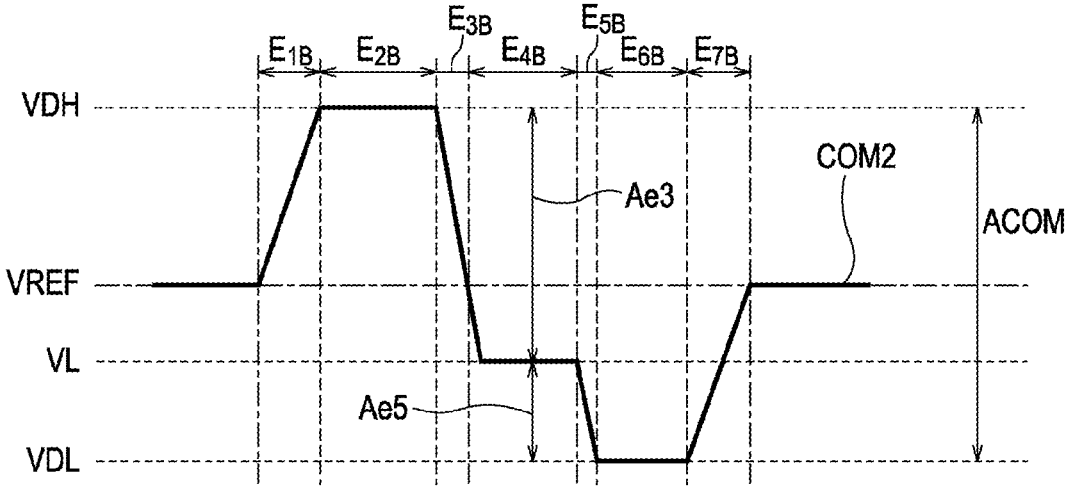

FIGS. 5A and 5B are examples of a periodic waveform of the first driving signal COM1 (FIG. 5A) and the second driving signal COM2 (FIG. 5B), respectively, that are 2 types of signals generated by the driving signal generation unit 64. In FIGS. 5A and 5B, a vertical axis indicates a voltage and a horizontal axis indicates time, and the time proceeds from left to right. As illustrated in FIGS. 5A and 5B, the first and second driving signals COM1 and COM2 are formed so that a difference ACOM between maximum voltage VDH and minimum voltage VDL may fit onto a predetermined range (for example, 35 V) specified in a standard, and any one is selected based on the ambient temperature detected by the temperature sensor 65. Incidentally, when the temperature is low, viscosity of the ink is high, and thus it is necessary to greatly contract (increase the displacement amount of the vibration unit 42) the bulk inside the pressure chamber 50 in order to eject the ink from the nozzle 56 (refer to FIG. 2, hereinafter, the same will be applied). Therefore, the first driving signal COM1 is selected. On the other hand, when the temperature is high, the viscosity of the ink is low, and change of the bulk (the displacement amount of the vibration unit 42) inside the pressure chamber 50 may be less. Therefore, the second driving signal COM2 is selected. Here, it means that the ambient temperature is within a predetermined range around 15° C., for example, when the temperature is low, and the ambient temperature is within another predetermined range around 25° C., for example, when the temperature is high.

The first driving signal COM1 includes an expansion element $E_{1A}$ expanding the pressure chamber 50, a retention element $E_{2A}$ maintaining an expansion state using the expansion element $E_{1A}$ for a certain period of time, a contraction element $E_{3A}$ contracting the pressure chamber 50, a retention element $E_{6A}$ maintaining a contraction state using the contraction element $E_{3A}$ for a certain period, and an expansion element $E_{7A}$ transiting to a next period by expanding the pressure chamber 50. However, in addition to an expansion element $E_{11B}$, a retention element $E_{2B}$, a contraction element $E_{3B}$, a retention element $E_{6B}$, and an expansion element $E_{7B}$, respectively, responding to the expansion element $E_{1A}$, the retention element $E_{2A}$, the contraction element $E_{3A}$, the retention element $E_{6A}$, and the expansion element $E_{7A}$ of the first driving signal COM1, the second driving signal COM2 includes a mist suppression element $E_{4B}$ (described later) maintaining the contraction state from an end of the contraction element $E_{3B}$ for a certain period of time and a contraction element $E_{5B}$ for a two-stage pressurization, and a retention element $E_{6B}$ and an expansion element $E_{7B}$ are continuously formed from an end of the contraction element $E_{5B}$. Here, as can be seen from the comparison of both, in the first driving signal COM1, the contraction element $E_{3A}$ contracting the pressure chamber 50 has a large voltage change, without passing through the mist suppression element which is a period of time maintained by a constant voltage (this will be described later) and further contraction elements, and the expansion element $E_{7A}$ and the retention element $E_{6A}$ which are a transitional period are formed in the next period. The first driving signal COM1 has a need for ejecting the ink with high viscosity in a low temperature area, and thus, it is necessary to make much voltage change of the contraction element $E_{3A}$ which contributes greatly to the ejection characteristic of the ink.

According to such a present embodiment, any one of the first and second driving signals COM1 and COM2 can be selected depending on the ambient temperature, and when the second driving signal COM2 is selected, it becomes possible to suppress the generation of the satellite droplets of the ejected ink droplets as much as possible.

As described above, the second driving signal COM2 of the present embodiment is a signal that realizes a pressurizing process divided into two stages such as pressurization (the contraction element $E_{3B}$)→maintaining pressurization (the mist suppression element $E_{4B}$)→pressurization (the contraction element $E_{BB}$). Here, the second driving signal COM2 has a properly set time length or voltage change amount of each element thereof. For example, as illustrated in FIG. 5B, the voltage change amount $A_e5$ ($A_e5$=VL−VDL) of the contraction element $E_{5B}$ falls below the voltage change amount $A_e3$ ($A_e3$=VDH−VL) of the contraction element $E_{3B}$. Specifically, it is preferable that the voltage change amount $A_e5$ of the contraction element $E_{5B}$ is set within the voltage change amount two fifths of $A_e3$ of the contraction element $E_{3B}$.

Figure 6:
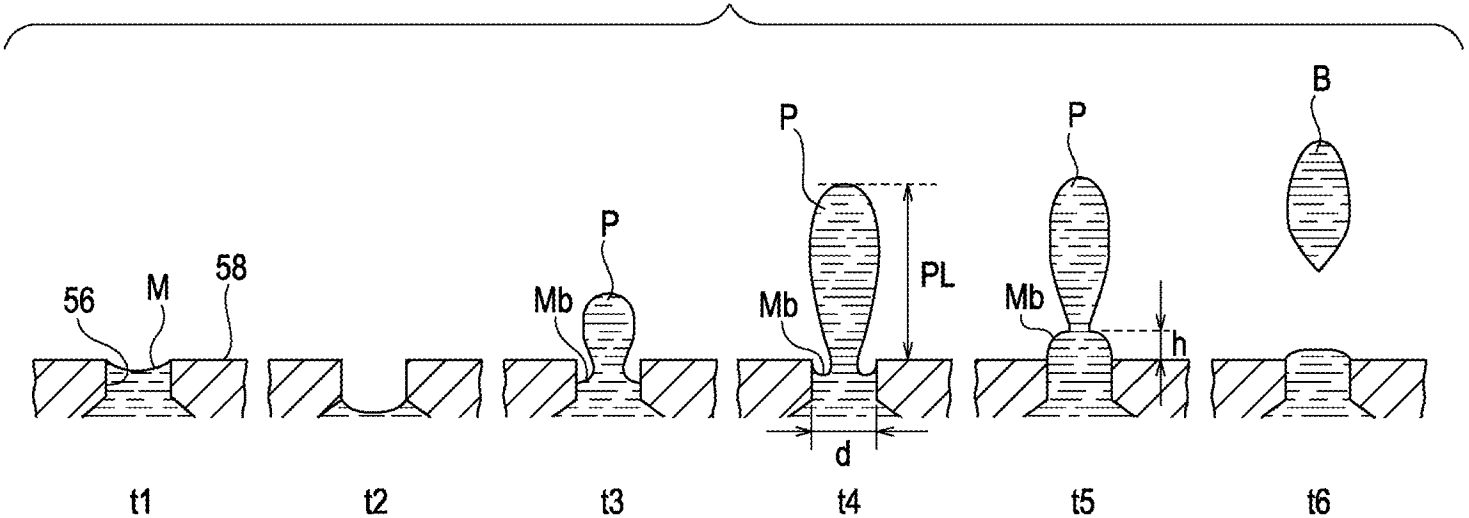
FIG. 6 is a view illustrating an ejection state of ink droplets.

Based on FIG. 6, an aspect where an ink droplet B is ejected from the nozzle 56 in the pressure chamber 50 by the supply of the second driving signal COM2 will be described in detail. FIG. 6 is a cross-sectional view of the nozzle 56, and illustrates a state where the ink droplet B is ejected by displacing ink surface M by a pressure change of the pressure chamber 50 in time series (time t1 to time t6). In FIG. 6, top of FIG. 6 is a direction that directs to outside of the pressure chamber 50, and the bottom of FIG. 6 is a direction that directs to inside of the pressure chamber 50. In other words, the direction of FIG. 6 and the direction of FIG. 2 are reversed to each other in an up and down direction. In addition, FIG. 7 illustrates a correspondence between each time (time t1 to time t6) of FIG. 6 and the time for the second driving signal COM2.

Figure 7:
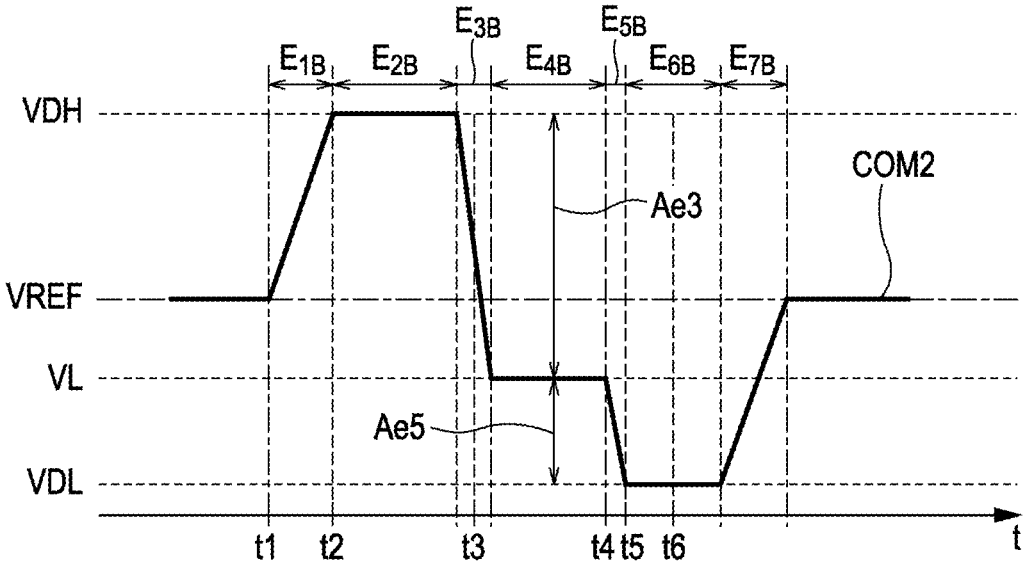
FIG. 7 is a view illustrating a correspondence between the second driving signal and ejection time of the ink droplets.

As illustrated in FIG. 7, in the time t1, since a reference voltage VREF is applied to the piezoelectric vibrator 422, the vibration plates (the island section 48 and the substrate 464) are not displaced and the pressure of the pressure chamber 50 is not increased and decreased. Therefore, the liquid surface M of the ink becomes a slight concavity (the time t1 in FIG. 6) by a surface tension.

After the time t1, a voltage corresponding to the expansion element $E_{1B}$ increasing to the voltage VDH in a high level is supplied to the piezoelectric vibrator 422, and the pressure chamber 50 is expanded and the pressure thereof is decreased. Because of the pressure decrement, the liquid surface M of the ink is drawn into the direction toward inside the pressure chamber 50, and then retreated from the ejection surface 58 (the time t2 in FIG. 6).

After the time t2, when the retention element $E_{2B}$ which maintains the voltage VDH reaches the end, the voltage is supplied to the piezoelectric vibrator 422, based on the contraction element $E_{3B}$ decreasing to the voltage VL in a low level, and the pressure chamber 50 is rapidly contracted to be pressurized. Because of this pressurization, the liquid surface M of the ink proceeds to the direction (ejection direction of the ink droplet B) toward outside the pressure chamber 50, and the ink is projected from a base surface Mb (a portion except for the surface of an ink column P in the ink droplet M) of the ink in the nozzle 56, thereby the ink column P is formed (the time t3 in FIG. 6).

After the time t3, when the contraction element $E_{3B}$ reaches the end, the retention element $E_{4B}$ which maintains the end voltage VL of the contraction element $E_{3B}$ is supplied to the piezoelectric vibrator 422. By the supply of the retention element $E_{4B}$, the pressurization to the pressure chamber 50 is stopped, but the ink column P further continues the expansion using an inertial force when projected from the nozzle 56. After the time t3, the ink column P is connected to the base surface Mb of the ink at the time t4 (the time t4 in FIG. 6).

In a state where the ink column P is connected to the base surface Mb of the ink, the contraction element $E_{5B}$ decreasing to the voltage VDL in the low level is supplied to the piezoelectric vibrator 422, and the pressure chamber 50 is further contracted, thereby the pressure inside the pressure chamber 50 is increased. Because of the pressure increment, the base surface Mb of the ink is extruded from the ejection surface 58 (the time t5 in FIG. 6). In addition, it is preferable that the contraction element $E_{5B}$ is started when the height PL with respect to the ejection surface 58 of the ink column P is two times the diameter d of the nozzle 56 or more and five times the diameter d of the nozzle 56 or less (2d≤PL≤5d), for example. The diameter d of the nozzle 56 is approximately 10 μm to 90 μm, for example. In addition, the supply of the contraction element $E_{5B}$ starts at 5 to 15 μs after the contraction element $E_{3B}$ starts to be supplied.

When the contraction element $E_{5B}$ reaches the end at the time t5, the retention element $E_{6B}$ maintaining the voltage VDL of end of the contraction element $E_{5B}$ is supplied to the piezoelectric vibrator 422. The ink column P still continues the expansion using an inertial force, and the base surface Mb of convex and the ink column P are divided in the time t6, thereby single ink droplet B is formed (the time t6 in FIG. 6). The divided ink droplet B flies according to the inertial force. The fling speed of the ink droplet B is approximately 5 m to 10 m per second, for example. Thereafter, the expansion element $E_{7B}$ which increases to a reference voltage VREF is supplied to the piezoelectric vibrator 422, and the pressure of the pressure chamber 50 is decreased.

In addition, in a case where the height h with respect to the ejection surface 58 in front end of the base surface Mb of the ink extracted by the contraction element $E_{5B}$ is a half of the diameter d of the nozzle 56 or more and three second of the diameter d of the nozzle 56 or less ((1/2)d≤h≤(3/2)d), an effect of suppressing the satellite droplet is great.

On the other hand, the driving signal COM1 (as in the second driving signal COM2, it is not the signal which realizes a pressurizing process divided into two stages) the same as the related art, does not have the retention element $E_{4B}$ and the contraction element $E_{5B}$, and thus the diameter of a tail portion of the ink column is increased and the ink column is considerably extended. For this reason, when the ink droplet (main droplet) is formed by dividing the ink column, the satellite droplet is also formed. In this manner, the pressurizing process is divided into two stages, thereby generation of the satellite droplet can be suppressed. Here, the mist suppression element $E_{4B}$ which is a pressure maintaining element following the contraction element $E_{3B}$ functions as an element suppressing the generation of the satellite droplets.

Figure 8A:
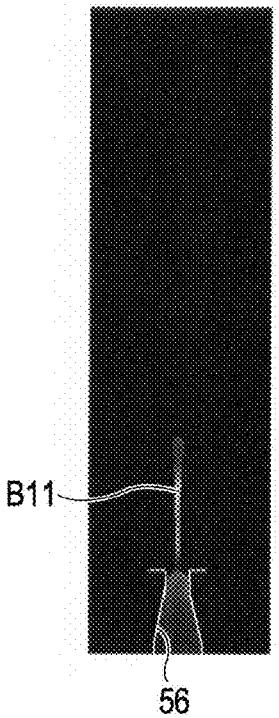
FIGS. 8A and 8B are simulation diagrams of flight of ink droplets using driving signals of the related art.
Figure 8B:
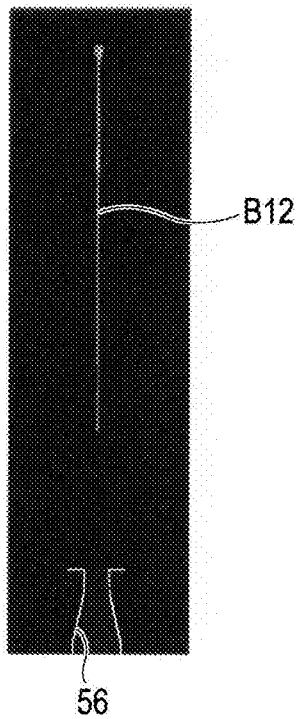
Figure 9A:
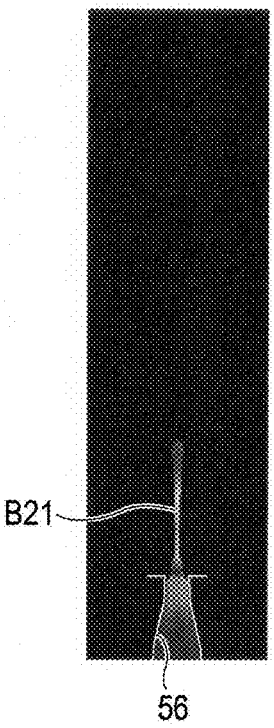
FIGS. 9A and 9B are simulation diagrams of flight of ink droplets using the second driving signal.
Figure 9B:
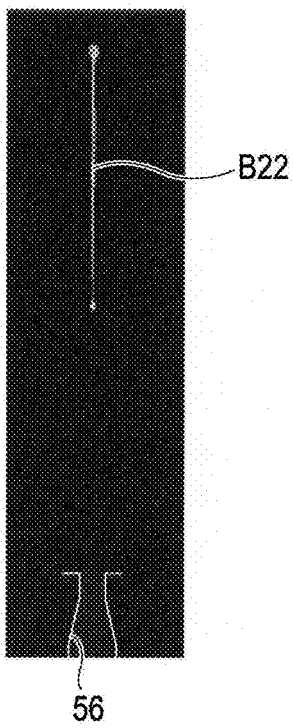

FIGS. 8A and 8B are a view illustrating a simulation result of flight of the ink droplets using the driving signal in the related art, and FIGS. 9A and 9B are a view illustrating a simulation result of the flight of the ink droplet using the second driving signal COM2. As illustrated in FIG. 8A, in a case where the driving signal in the related art is used, an ink droplet B11 (a shape extending upward with a lower end portion contacted to a nozzle hole) ejected from the nozzle 56 (a taper shaped member in a low portion in FIG. 8A) becomes an ink droplet B12 and flies by leaving long tails as illustrated in FIG. 8B. In contrast to this, as illustrated in FIG. 9A, when the second driving signal COM2 is used, the ink droplet B21 ejected from the same nozzle, thereafter, as illustrated in FIG. 9B, flies by leaving remarkably shortened tail as the ink droplet B22 compared with FIG. 8B. In this case, the length of the tail is closely related with the generation of the satellite droplets, and in a case where the tail is short, the generation of the satellite droplets are less. Thus, the second driving signal COM2 side which adopts the two-stage pressurizing method suppresses more the generation of the satellite droplets.

As described above, when the second driving signal COM2 which realizes the two-stage pressurizing method is used, that is, the case where a signal having the mist suppression element $E_{4B}$ and subsequent contraction element $E_{5B}$ is used effectively prevents the satellite droplets from generating. Therefore, if the difference ACOM between the maximum voltage VDH and minimum voltage VDL can be fit onto the predetermined range (for example 35 V) specified in the standard, it is preferable that the first driving signal COM1 also adopt the two-stage pressurizing method by forming elements corresponding to the retention element $E_{4B}$ and the contraction element $E_{5B}$. It is because the generation of the satellite droplets can be suppressed even in the low temperature range as well as in the high temperature range.

Figure 10:
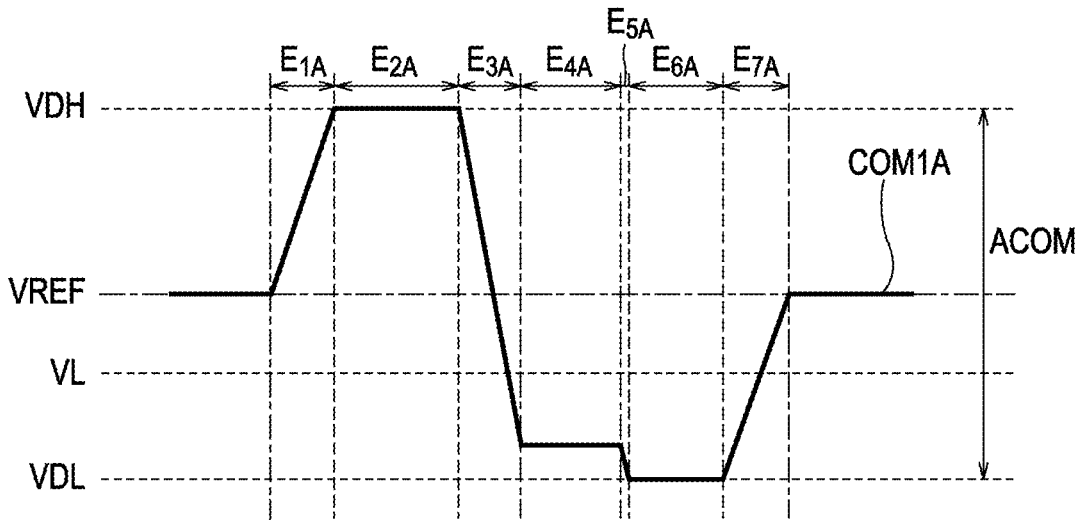
FIG. 10 is a waveform diagram illustrating another example of the first driving signal.

The waveform of the first driving signal COM1A in this case is illustrated in FIG. 10. As illustrated in FIG. 10, the first driving signal COM1A has the contraction element $E_{3A}$ followed by the mist suppression element $E_{4A}$ and the contraction element $E_{5A}$ for the two-stage pressurizations. Here, the voltage difference between the voltage of the starting point of the contraction element $E_{3A}$ and the voltage of the ending point of the contraction element $E_{5A}$ is formed as same as the difference ACOM between the maximum voltage VDH and the minimum voltage VDL, for example. However, the voltage difference between the starting point and the ending point of the contraction element $E_{3A}$ is larger than that of the contraction element $E_{3B}$, and the voltage difference between the starting point and the ending point of the contraction element $E_{5A}$ is smaller than that of the contraction element $E_{5B}$. In this manner, although the voltage difference between the starting point and the ending point of the contraction element $E_{5A}$ is smaller than that of the contraction element $E_{5B}$, the two-stage pressurizing method can effectively suppress the generation of the satellite droplets. However, it is preferable to form the suppression element $E_{4A}$ and the contraction element $E_{5A}$ for the two-stage pressurizations like the first driving signal COM1A, within constraints such as a range allowed by the difference ACOM.

In addition, in FIG. 10, like symbols are assigned to the same portion as each element illustrated in FIG. 5A, and the repeated descriptions are omitted.

Another Embodiment

As described above, the first embodiment of the invention is described, but the basic configuration of the invention is not limited to the above description. For example, in the above-described embodiment, a vertical vibration type of the piezoelectric vibrator 422 is used as a pressure generation unit, but specifically it is not limited thereto, for example, a piezoelectric element with a flexural deformation type formed by laminating a bottom electrode, a piezoelectric layer, and a top electrode may be used. Incidentally, if the vertical vibration type of the piezoelectric vibrator 422 is used, the piezoelectric vibrator 422 is contracted in the vertical direction to expand the pressure chamber 50 by being charged, and the piezoelectric vibrator 422 is extended in the vertical direction to contract the pressure chamber 50 by being discharged. In contrary to this, in a case where the piezoelectric element with the flexural deformation type is used as the piezoelectric generation unit, the piezoelectric element is deformed to the pressure chamber 50 by being charged and thus the pressure chamber 50 is contracted, and the piezoelectric element is deformed to a side opposing to the pressure chamber 50 by being discharged and thus the pressure chamber 50 is expanded. The driving signal which drives such the piezoelectric element becomes a shape which is formed by inverting a voltage polarity of the above-described driving signal.

In addition, as the pressure generation unit, a so-called electrostatic actuator or the like may be used, which ejects the liquid droplets from the nozzle 56 by deforming the vibration plate using an electrostatic force generated by static electricity between the vibration plate and the electrode.

In addition, the above-described printing apparatus 100 exemplifies the recording head 22 which is mounted on the carriage 12 and moved in the main scanning direction, but in particular, it is not limited thereto. For example, the recording head 22 is fixed and then printed by simply moving recording media such as the recording sheet 200 in the sub-scanning direction, and the invention can be applied to even a so-called line type recording apparatus.

Furthermore, the invention is widely targeted at all of a liquid ejecting head, for example, it is possible to apply to the recording head such as various ink jet type recording heads used in an image recording apparatus of a printer or the like, a color material ejection head used in manufacturing a color filter such as a liquid crystal display, an electrode material ejection head used in forming the electrode such as an organic EL display or FED (Field Emission Display), a biological organic substance ejection head used in manufacturing a bio-chip, or the like. Of course, the liquid ejecting apparatus on which such a liquid ejecting head is mounted is not also limited in particular.

The entire disclosure of Japanese Patent Application No. 2012-055136, filed Mar. 12, 2012, is incorporated by reference herein.

What is claimed is:

1. A liquid ejecting apparatus comprising:

a liquid ejecting head in which a pressure inside a pressure chamber is varied by a pressure generation unit and liquid in the liquid ejecting head is ejected from a nozzle as liquid droplets; and a control unit which includes a driving signal generation unit generating a driving signal which operates the pressure generation unit, wherein the driving signal generation unit fits a difference between a maximum voltage and a minimum voltage within a predetermined range, and generates a first driving signal that is transmitted to drive the liquid ejecting head when an ambient temperature detected by a temperature sensor is within a predetermined low temperature range, and a second driving signal that is transmitted to drive the liquid ejecting head when the temperature detected by the temperature sensor is within a predetermined high temperature range, wherein the first and second driving signals include:

a first contraction element that forms a liquid column by pressurizing the pressure chamber and projecting the liquid in the nozzle, a second contraction element that projects the pressure chamber in a projecting direction of the liquid column from a position where a liquid surface inside the nozzle is connected to an internal surface of the nozzle, in a state where at least the second driving signal pressurizes the pressure chamber after the first contraction element, the liquid column is connected to the liquid in the nozzle, and a mist suppression element provided between the first contraction element and the second contraction element to maintain contraction of the pressure chamber after the first contraction element, wherein the mist suppression element of the first driving signal and the mist suppression element of the second driving signal are provided between respective first contraction element and respective second contraction element such that a voltage change amount of the second contraction element of the first driving signal is less than a voltage change amount of the second contraction element of the second driving signal, and wherein a voltage change amount of the first contraction element of the first driving signal is more than a voltage change amount of the first contraction element of the second driving signal.

2. The liquid ejecting apparatus according to claim 1, wherein a voltage change width of the second contraction element of the second driving signal is within two fifths of the voltage change width of the first contraction element.

3. The liquid ejecting apparatus according to claim 1, wherein when a height with respect to an ejection surface of the liquid column formed by the first contraction element of the second driving signal is two times a diameter of the nozzle to five times the diameter of the nozzle, the second contraction element is started.

4. The liquid ejecting apparatus according to claim 1, wherein a height with respect to an ejection surface of the liquid surface projected by the second contraction element of the second driving signal is a half of a diameter of the nozzle to three seconds of the diameter of the nozzle.

5. The liquid ejecting apparatus according to claim 1, wherein time t between an application start of the second contraction element of the second driving signal and an application start of the first element is $Tc/2<t<Tc$, wherein Tc is a period of natural vibration of the pressure chamber.

6. The liquid ejecting apparatus according to claim 1, wherein for the first driving signal and the second driving signal, the first contraction element and the second contraction element have a decreasing voltage slope.

7. The liquid ejecting apparatus according to claim 1, wherein for the first driving signal and the second driving signal, the mist suppression element is provided directly between the first contraction element and the second contraction element.

8. The liquid ejecting apparatus according to claim 1, wherein in the first driving signal, the first contraction element decreases from a high-voltage level to a first mid-voltage level and the second contraction element decreases from the first mid-voltage level to a low-voltage level, and in the second driving signal, the first contraction element decreases from the high-voltage level to a second mid-voltage level different from the first mid-voltage level and the second contraction element decreases from the second mid-voltage level to the low-voltage level.

* * * * *